US007301426B2

(12) United States Patent
Lammers

(10) Patent No.: US 7,301,426 B2
(45) Date of Patent: Nov. 27, 2007

(54) ELECTROMAGNETIC ACTUATOR

(75) Inventor: Arend Jan Willem Lammers, Hengelo (NL)

(73) Assignee: Eaton Electric B.V., Hengelo (NL)

( * ) Notice: Subject to any disclaimer, the term of this patent is extended or adjusted under 35 U.S.C. 154(b) by 199 days.

(21) Appl. No.: 10/555,996

(22) PCT Filed: Apr. 22, 2004

(86) PCT No.: PCT/NL2004/000267

§ 371 (c)(1),
(2), (4) Date: Nov. 8, 2005

(87) PCT Pub. No.: WO2004/100198

PCT Pub. Date: Nov. 18, 2004

(65) Prior Publication Data

US 2006/0279386 A1 Dec. 14, 2006

(30) Foreign Application Priority Data

May 9, 2003 (NL) ..... 1023381

(51) Int. Cl.
*H01F 7/00* (2006.01)

(52) U.S. Cl. ..... 335/234; 335/229; 335/255; 335/256; 335/264; 335/266; 335/267; 335/268

(58) Field of Classification Search ..... 335/179, 335/229–234, 255, 256, 264, 266–268; 251/129.16; 123/90.11

See application file for complete search history.

(56) References Cited

U.S. PATENT DOCUMENTS 4,072,918 A * 2/1978 Read, Jr. ..... 335/236
4,127,835 A 11/1978 Knutson
4,419,643 A * 12/1983 Ojima et al. ..... 335/234
4,550,302 A * 10/1985 Watanabe et al. ..... 335/228
5,034,714 A 7/1991 Bratkowski et al.
5,864,274 A 1/1999 Steingroever et al.
6,130,594 A 10/2000 Morant et al.
6,262,648 B1 * 7/2001 Lammers ..... 335/229

FOREIGN PATENT DOCUMENTS

EP 1 225 609 A2 7/2002
WO WO 99/14769 A 3/1999

* cited by examiner

*Primary Examiner*—Ramon M. Barrera
(74) *Attorney, Agent, or Firm*—Kirk D. Houser; Eckert Seamans Cherin & Mellott, LLC

(57) ABSTRACT

Electromagnetic actuator for operating at least one movable contact of a switch into a switched-on position or a switched-off position. The electromagnetic actuator (1) has a first magnetic circuit for making a movable (3) and a fixed (4) pole body move towards one another and a second magnetic circuit, separate from the first magnetic circuit, with a permanent magnet (9) and a retaining plate (10). A switching-off coil (15) operates to counteract the magnetic field in the second magnetic circuit so that the actuator (1) can return to a switched-off position. In the axial direction of the actuator (1), the switching-off coil (15) is positioned Gloser to the retaining plate (10) than the permanent magnet (9), as a result of which more effective operation of the actuator is possible. Furthermore, the actuator is constructed from cylindrical elements that are easy to produce and to assemble.

19 Claims, 2 Drawing Sheets

ELECTROMAGNETIC ACTUATOR

BACKGROUND OF THE INVENTION

1. Field of the Invention

The present invention relates to an electromagnetic actuator for operating at least one movable contact of a switch into a switched-on position or a switched-off position, wherein the electromagnetic actuator has a first magnetic circuit with a switching-on coil for making a movable and a fixed pole body move towards one another until the switched-on position is reached, a second magnetic circuit, separate from the first magnetic circuit, with a permanent magnet and a retaining plate joined to the movable pole body, for holding the actuator in the switched-on position against any spring or other forces when the switching-on coil is not energised, and a switching-off coil that operates to counteract the magnetic field in the second magnetic circuit so that the actuator can return to a switched-off position. The second magnetic circuit contains the permanent magnet, the retaining plate, the switching-off coil and a circuit body closing the second magnetic circuit, wherein the second magnetic circuit provides an increasing force of attraction between the circuit body and the retaining plate during the movement from the switched-off position into the switched-on position.

In further aspects this invention relates to a method for the production of an electromagnetic actuator and to an assembly for fixing an actuator, such as an actuator according to the present invention, in a switching installation which has at least one movable contact of a switch.

2. Background Information

An electromagnetic actuator of this type is disclosed in International Patent Publication WO 99/14769. As a result of the separate magnetic circuits, the actuator can be optimised as far as the switching-on and switching-off speeds and the requisite switching-on and switching-off energy are concerned. However, the actuator described in this publication can be even further improved, both in terms of operational use of the actuator and in terms of production of the actuator.

SUMMARY OF THE INVENTION

The aim of the present invention is to provide an electromagnetic actuator that is easier to produce, at lower cost, and that is more efficient in use compared with the state of the art.

According to the present invention an electromagnetic actuator in accordance with the type defined in the preamble is provided, wherein, in the axial direction of the actuator, the switching-off coil is positioned closer to the retaining plate than the permanent magnet. As a result of this modified positioning of permanent magnet and switching-off coil compared with the actuator known from patent publication WO 99/14769, the operation of the switching-off coil is more effective, as a result of which less energy is needed for the switching-off action of the present actuator.

A further example of an electromagnetic actuator is disclosed in U.S. patent application U.S. Pat. No. 5,864,274. This type of actuator includes a cylindrical soft-iron vessel with permanent magnets arranged to form a shunt-magnetic gap with the inside wall of the soft-iron vessel. The neck of the flux conducting disk is surrounded by a current winding. A magnetically attractable pole disk lies on the neck of the soft-iron vessel. An electrically conducting ring is fastened to the pole disk. The pole disk activates mechanical and/or electrical safety devices. The system is activated by a current impulse sent to the current winding. This actuator does not comprise a switching-on coil, and in the case of no external activation of the coil, the actuator returns to its normal position, in which the pole rests against the (neck of the) flux conducting disk. As described, this actuator is arranged to relatively quickly push away the pole disk for a short time, which is achieved by forcing the magnetic flux to move away from the pole disk, and by using the short-circuit conducting ring to provide a push away force. This is made possible by having the magnetic circuit formed by the soft-iron vessel, the permanent magnet, flux conducting disk and pole disk, in which the diameter of the permanent magnet is smaller than the diameter of the soft-iron vessel (the permanent magnet lies within the soft-iron vessel).

However, in the present invention, the switching-off action is initiated by counteracting the magnetic flux of the permanent magnet, which is holding the retaining plate, by a magnetic flux generated by the switching-off coil but in the same magnetic flux path. This allows to put the permanent magnet at a more radially outward located position than the position taught by U.S. Pat. No. 5,864,274, thus ensuring that the moveable pole body (part of the primary circuit of the switching-on coil) is not influencing the secondary magnetic circuit of the actuator. This allows to make a more compact actuator, requiring less length, as the elements of the holding arrangement (permanent magnet, fitting body, etc) can be positioned substantially co-axially with parts of the switching-on arrangement (in particular the relatively large moveable pole body).

In a further embodiment the permanent magnet is a disc-shaped magnet, the pole orientation of which is parallel to the axis of the disc-shaped magnet. Permanent magnets of this type are easy and inexpensive to produce, especially in comparison with the permanent magnet described in WO 99/14769 that requires a pole orientation in the radial direction. Furthermore, the production tolerances can be greater with the present disc-shaped permanent magnet because the second magnetic circuit runs differently and an axial tolerance is easier to eliminate than a radial.

In a further embodiment the actuator comprises essentially cylindrical elements. The cylindrical elements from which the actuator is made up are in general easy to produce with the use of techniques known per se, for example with the use of a lathe. The cylindrical structure of the actuator is also more efficient compared with the state of the art in respect of the magnetic circuit produced and the amount of space that the actuator takes up.

Furthermore, the various elements can be assembled easily, for example by means of (screw) fasteners and/or press fittings.

In yet a further embodiment the actuator comprises cylindrical elements in the first and second magnetic circuit that are made of steel, for example free-cutting steel. This material is less expensive and easier to machine than the generally customary magnetic tin plate. It is true that this results in a loss of magnetic effectiveness, but this can easily be compensated for and is not outweighed by the economic advantage achieved.

In a further embodiment the electromagnetic actuator comprises a movable shaft joined to the movable pole body, which shaft can move relative to the fixed pole body by means of a plain bearing. The use of a plain bearing offers the advantage that the actuator is closed off from the environment, so that no magnetisable material and/or other contamination can accumulate on the pole bodies.

Furthermore, in a further embodiment of the present electromagnetic actuator the movable pole body can move only in the axial direction relative to the circuit body by means of a plain bearing. This simple and inexpensive fixing is made possible by the cylindrical construction of the actuator.

So as also to prevent magnetisable particles or other contaminants from the outside accumulating in the air gap in the second magnetic circuit, the actuator is provided with a dust cap that screens off the air gap between a circuit body (where the circuit body closes the second magnetic circuit between permanent magnet and retaining plate) and the retaining plate. Once again, such a dust cap, which, of course, must provide room for the possible movement of the various components in the actuator, is easy and inexpensive to fit because of the cylindrical construction.

In a further aspect the present invention relates to a method for assembling an actuator according to the present invention, wherein at least two of the cylindrical elements are fixed to one another by means of a screw fastener. As a result of the cylindrical structure, this is easily possible by making suitable holes in the cylindrical elements.

As an alternative, or for specific parts of the actuator, in a further embodiment at least two of the cylindrical elements can be fixed to one another by a press fit. This is advantageous in particular if two elements, for example, have to be aligned in the axial direction during production. For example, in the actuator according to U.S. Pat. No. 5,864,274, the flux conducting disk and edge of the soft-iron vessel need to be aligned, e.g. by machining the disk and/or the edge of the soft-iron vessel. This machining is an additional step, which will raise the cost of the actuator. Furthermore, iron parts may be attracted by the permanent magnet, which iron parts will be difficult to remove again. In the actuator manufactured according to this embodiment of the present invention, an adapter body, which together with the housing and a fixing body, by means of which the permanent magnet is fixed to the housing, forms the circuit body closing the second magnetic circuit, can be aligned with the fixing body, so that in the switched-on position these two parts precisely butt up against the retaining plate. In this way the customary grinding operation for the contact surfaces becomes superfluous.

In known actuators, e.g. as described in U.S. Pat. No. 5,864,274, the permanent magnet must be located inside a vessel shaped body, but can not touch the inside wall of the vessel. This is a very cumbersome manufacturing step, both with respect to proper positioning, but also because there is a chance the magnet will be pulled to the bottom of the vessel with great force, resulting in possible breaking of the permanent magnet. In the present invention, the permanent magnet may be put in the right position by shifting, after which the alignment may take place.

In yet a further aspect the present invention relates to an assembly for fixing an actuator, such as an actuator according to the present invention, in a switching installation which has at least one movable contact of a switch, wherein the axial axis of the actuator is essentially perpendicular to the direction of movement of the operating means for the at least one movable contact of the switch. As a result of such an arrangement, a switching installation can be produced that makes efficient use of the available space. It is pointed out that in the state of the art (see, for example, the abovementioned patent publication WO 99/14769 or the U.S. Patent Publication US-A-2002/0093408) the direction of movement of the actuator is parallel to the direction of movement of the contacts of the switch(es). Of course, the actuator according to the invention can also be used in this way.

In a further embodiment the assembly furthermore comprises transmission means with a predetermined transmission ratio between the movement of the actuator and the movement of the operating means for the at least one movable contact of the switch. If, for example, one actuator in the assembly drives three movable contacts of a switch, the predetermined transmission ratio is between 1:2 and 1:2.5 and when used with the conventional vacuum switches is preferably 1:2.2. The transmission ratio makes it possible to achieve an efficient design of the actuator (and/or switching installation), with which design specifications, such as switching-on and switching-off time, energy required for the switching-on and switching-off coil, design of further energy storage means (contact pressure springs, compensation springs, etc.) are optimised.

BRIEF DESCRIPTION OF THE DRAWINGS

The present invention will now be discussed in more detail on the basis of a number of illustrative embodiments with reference to the appended drawings, in which.

DESCRIPTION OF THE PREFERRED EMBODIMENTS

Figure 1:
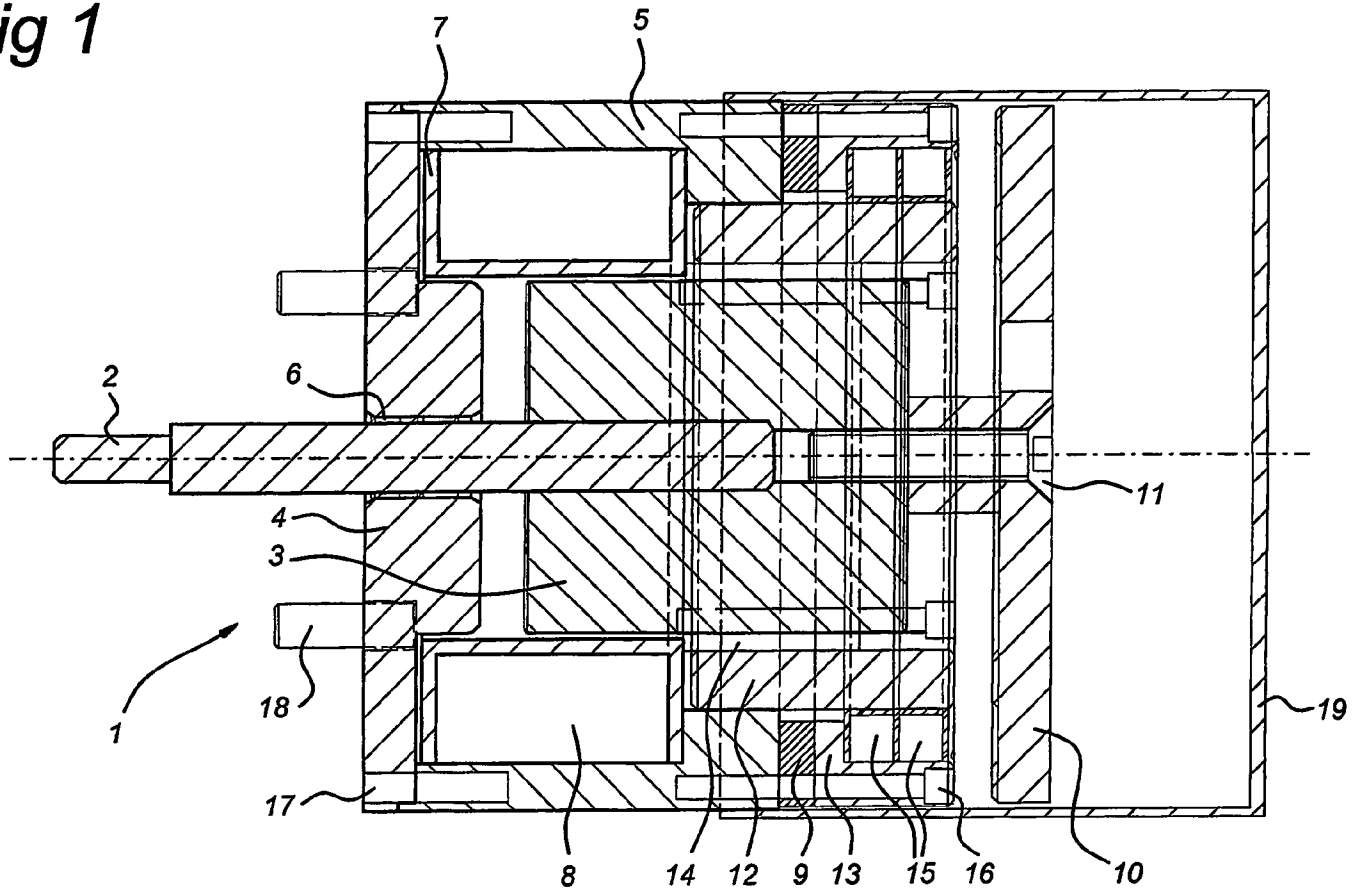
FIG. 1 shows a cross-sectional view of one embodiment of the electromagnetic actuator.

A cross-sectional view of one embodiment of an electromagnetic actuator 1 is shown in FIG. 1. The actuator 1 has a movable shaft 2 that can be connected (directly or indirectly) to a moving contact of a switch (not shown). Actuators for operating switches in medium voltage installations, for which the present actuator 1 is also suitable, are, for example, disclosed in the patent publication WO 99/14769, which must be considered to have been incorporated here by means of reference.

The actuator 1 comprises a first (movable) pole body 3 joined to the movable shaft 2 and a second (fixed) pole body 4, which is joined to a housing 5. The movable shaft 2 can move relative to the second pole body 4 by means of a plain bearing 6. A first coil holder 7, with a switching-on coil 8 therein, is positioned at the location of the air gap between the first pole body 3 and second pole body 4. By making current flow through the switching-on coil 8, a magnetic field is generated that runs via the housing 5, first pole body 3, second pole body 4 and the air gap between the first and second pole body 3, 4 (the first and second pole body 3, 4 and the housing 5 being made of magnetically conducting material). As a result a force of attraction is produced between the first and second pole body 3, 4, as a result of which the movable shaft 2 moves to the left (and thus switches on the switch connected to the actuator).

To hold the actuator 1 in this switched-on position without energy being needed to energise the switching-on coil 8, a second, separate magnetic circuit is provided (see also the abovementioned patent publication WO 99/14769). In the embodiment shown the second magnetic circuit contains a permanent magnet 9 in the form of a disc-shaped ring, the north/south orientation of which is parallel to the axis of the disc-shaped ring. This makes production of the permanent magnet 9 simpler and less expensive and also makes the insensitivity to tolerance greater compared with the state of the art. In the embodiment shown, the movable shaft 2 is joined to a retaining plate 10 (for example as shown with a screw fastener 11). The permanent magnet 9 is joined to the housing 5 with the aid of a fixing body 13 (and, for example, with screw fasteners 16). An adapter body 12 in the form of a cylinder provides for closure of the magnetic circuit from the one pole of the permanent magnet 9, via housing 5, adapter body 12, retaining plate 10 and fixing body 13 to the other pole of the permanent magnet 9. The second magnetic circuit therefore comprises the permanent magnet 9, retaining plate 10 and a circuit body, which contains part of the housing 5, the fixing body 13 and the adapter body 12, closing the second magnetic circuit. In order to obtain this magnetic circuit there is an air gap between permanent magnet 9 and adapter body 12 and between fixing body 13 and adapter body 12. The first pole body 3 can move relative to the adapter body 12 only in the axial direction by use of a plain bearing 14.

As soon as the actuator 1 is energised with the aid of the switching-on coil 8, the retaining plate 10 will move to the left in the drawing, as a result of which air gaps between retaining plate 10 and the fixing body 13 and between retaining plate 10 and adapter body 12 will become increasingly smaller. The force of attraction of the second magnetic circuit becomes very high when the said air gap is sufficiently small, which makes a substantial contribution to forcing the actuator 1 into the switched-on position. In the switched-on position (in which the air gaps have virtually completely disappeared) the force of attraction on the retaining plate is sufficient to hold the actuator 1 in this position against any forces acting in the opposite direction.

As discussed and explained in the patent publication WO 99/14769, the magnetic circuits of the switching-on coil 8 and the permanent magnet 9 are completely separate.

To switch off the actuator, a switching-off coil 15 is provided, which is also fitted in a coil holder. The switching-off coil 15 is sized such that in the case of correct actuation this counteracts the magnetic field of the permanent magnet 9, so that the energy that has been stored in a contact pressure spring of the switch to be operated and an optional additional switching-off spring (not shown) is sufficient to move the movable shaft 2 fully back.

Compared with the actuator shown in the publication WO 99/14769, the positions of the switching-off coil 15 and permanent magnet 9 have been reversed. As a result of the position of the switching-off coil 15 in the present actuator 1, the latter can operate more effectively, as a result of which it can be made smaller and in operation requires a lower power feed in order to obtain the same switching-off action.

The second magnetic circuit in the present actuator 1 is longer compared with the actuator shown in patent publication WO 99/14769, as a result of which the magnetic resistance is higher. However, this can easily be compensated for by using a stronger permanent magnet 9. As a result of the chosen position of the permanent magnet 9 and the make up of the second magnetic circuit, the permanent magnet 9 can be a simple disc-shaped magnet with a north/south orientation parallel to the axis thereof, in contrast to the cylindrical permanent magnet with a north/south orientation running radially that is required in WO 99/14769. The present permanent magnet 9 is consequently easier and less expensive to produce.

In the embodiment as described above, the actuator 1 comprises components that all make a cylindrical structure of the actuator 1 possible. Thus, the housing 5, first pole body 3, second fixed pole body 4, retaining plate 10, adapter body 12 and fixing body 13 can easily be produced with simple machining (for example on a lathe) of the magnetic conductive material, for example free-cutting steel. Free-cutting steel has the advantage that it is less expensive than magnetic tin plate, which is usually employed. Although the magnetic properties of free-cutting steel are poorer than those of magnetic tin plate, this can easily be adapted by using proportionally more material. The permanent magnet 9 can be a disc-shaped magnet that is easy to produce or to obtain. The second fixed pole body 4, permanent magnet 9 and fixing body 30 can easily be fixed to the housing 5 by means of, for example, screw fasteners 16, 17.

The adapter body 12 preferably has a cylindrical shape such that it can be fixed in the housing 5 by a press fit. Preferably this is done last, so that the correct position of the adapter body 12 with respect to the fixing body 13 is automatically obtained (that is to say such that the ends of the adapter body 12 and fixing body 13 precisely butt up against the retaining plate 10 when the actuator 1 is in the energised position).

As a result of the housing 5 and the precise fit (plain bearing 6) between the movable shaft 2 and the second pole body 4, the pole surfaces of the first and second pole body 3, 4 are adequately protected against outside influences. In particular, metallic particles are prevented from entering the actuator 1 as a result of magnetic attraction and possibly causing malfunctions there.

In order to obtain the same sort of protection on the other side of the actuator 1 it suffices to fix a sleeve-shaped closure 19. This closure can be fitted around the housing 5 by means of a press fit. In this case it is preferable that the dust cap provides adequate space for the movement of the retaining plate 10 and that the air is not compressed in the closure (for example by making holes in the retaining plate 10). By means of tailored sizing and positioning of the holes it is also readily possible to damp the speed or to suck or blow away dirt particles.

The cylindrical structure of the present actuator 1 gives a very robust construction, a uniform distribution of the magnetic field lines and a maintenance-free construction.

In a switching installation with one or more movable contacts of a switch, the actuator 1 can be used to actuate one or more of the movable contacts of the switch. In the illustrative embodiment below, that is shown diagrammatically in FIG. 2, an assembly of one actuator 1 according to the present invention with fixing means and transmission means for fitting in the switching installation is discussed. It is pointed out that the construction discussed below is also suitable for other types of actuators 1.

The fixing means comprise two fixing plates 20, 21 arranged in parallel and mirroring one another that can be produced easily using machining techniques known per se, such as flanging and drilling holes.

The actuator 1 is mounted on two flanged parts of the fixing plates 20, 21 with the aid of mounting pins 18 (see also FIG. 1). The axis of the actuator 1 (and thus the direction of movement of the movable shaft 2) is oriented along a first direction (longitudinal direction of movable shaft 2 in FIG. 2). There are transmission means so that the movable shaft 2 of the actuator 1 moves essentially perpendicularly to a second direction (vertical direction in FIG. 2). The second direction is the direction of movement of the contact rods for the moving poles of the switches. This makes a very compact construction of the installation possible.

The transmission means comprise the following components. The movable shaft 2 is connected via a first connecting rod 22 and a pivot joint 23 to a first transmission body 24. This first transmission body 24 has an essentially triangular shape, the pivot joint 23 being at one corner thereof. The first transmission body 24 is attached to the fixing plates 20, 21, such that it can turn, at an opposing corner by means of a pin fastener 25. The contact rod for one of the switches can be attached to the other corner and a pin 26 is fitted that, in conjunction with an opening 27 in the fixing plates 20, 21, ensures that the pin can move only in the second direction.

By varying the ratio of the distance between the pin fastener 25 and pen 26, on the one hand and the distance between the pin fastener 25 and the pivot joint 23, on the other hand, a scalable transmission ratio from the movement of the movable shaft 2 of the actuator 1 to the contact rod for the switch is possible. The transmission ratio is determined by, on the one hand, the desired speed (switching-on and switching-off speed of the switches), a lower transmission ratio yielding a higher speed, and, on the other hand, by the forces that the actuator 1 has to produce and absorb, a higher transmission ratio enabling greater absorption of forces.

Figure 2:
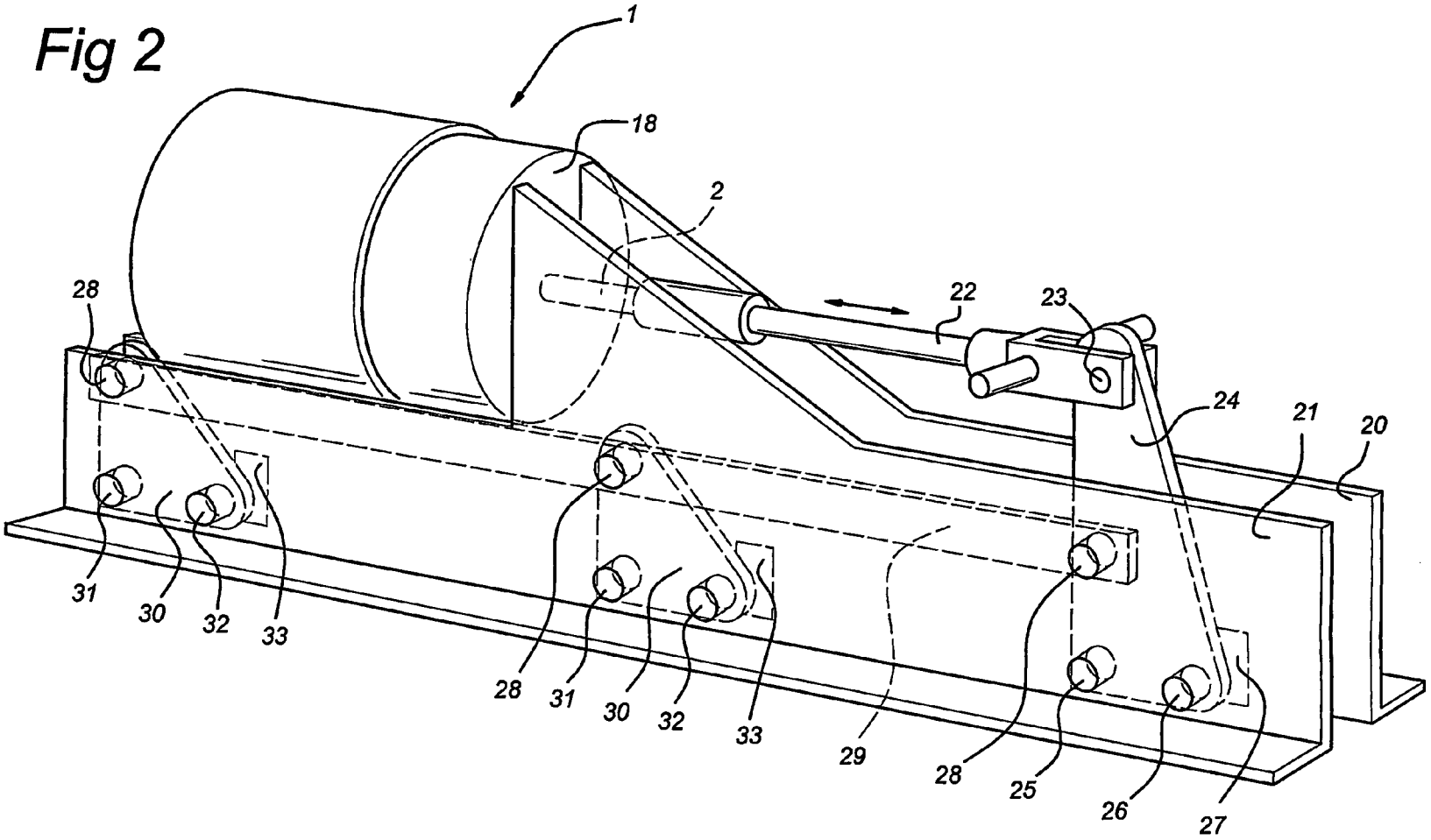
FIG. 2 shows a perspective view of a set-up of electromagnetic actuator with drive elements and fixing.

In the illustrative embodiment shown in FIG. 2, one actuator 1 is used to drive three movable contacts of the switch. This is made possible by using a further transmission rod 29 that is attached to the first transmission body 24 using a further pin fastener 28. The transmission rod 29 is attached in a congruent manner by means of further pin fasteners 28 to two further transmission bodies 30, which are attached to the fixing plates 20, 21, such that they can turn, using further pin fasteners 31. Contact rods for the other switches can be attached to the remaining corner of the further transmission bodies 30 using a pin 32 that can move vertically in openings 33 in the fixing plates 20, 21. It will be clear to a person skilled in the art that variations to this construction can be employed, for example by positioning the first transmission body 24 in the middle, with the further transmission bodies 30 on either side thereof.

It has been found that in the case of a single actuator 1 according to the present invention and three movable contacts of a switch that are to be operated, the transmission ratio has a specific optimum. This optimum is located in the range between 1:2 and 1:2.5, for example 1:2.2. It is thus surprisingly lower than the ratio of 1:3 to be expected from the combination of an actuator 1 and three movable contacts of a switch.

An ancillary advantage is that as a result of the relatively longer stroke of the actuator, the force of attraction that is generated in the air gap in the second magnetic circuit decreases relatively more rapidly, as a result of which an even more rapid switching-off time can be obtained.

It will be clear to a person skilled in the art that the embodiments described above are merely examples to illustrate the present invention. Modifications and changes are considered to be included in the scope of protection of the present invention as defined by the appended claims.

The invention claimed is:

1. Electromagnetic actuator for operating at least one movable contact of a switch into a switched-on position or a switched-off position, wherein the electromagnetic actuator has a first magnetic circuit with a switching-on coil for making a movable and a fixed pole body move towards one another until the switched-on position is reached, a second magnetic circuit, separate from the first magnetic circuit, with a permanent magnet and a retaining plate joined to the movable pole body, for holding the actuator in the switched-on position against any spring or other forces when the switching-on coil is not energised, and a switching-off coil that operates to counteract the magnetic field in the second magnetic circuit so that the actuator can return to a switched-off position, characterised in that in the axial direction of the actuator, the switching-off coil is positioned closer to the retaining plate than the permanent magnet, and in that the second magnetic circuit comprises the permanent magnet, an adapter body, a fixing body for mounting the permanent magnet to the adapter body and the retaining plate, and in which the permanent magnet is positioned radially outside the adapter body.

2. Electromagnetic actuator according to claim 1, wherein the permanent magnet is a disc-shaped magnet, the pole orientation of which is parallel to the axis of the disc-shaped magnet.

3. Electromagnetic actuator according to claim 1, wherein the actuator comprises essentially cylindrical elements.

4. Electromagnetic actuator according to claim 3, wherein the actuator comprises cylindrical elements in the first and second magnetic circuit that are made of steel.

5. Electromagnetic actuator according to claim 1, wherein the electromagnetic actuator comprises a movable shaft joined to the movable pole body, which shaft can move relative to the fixed pole body by means of a plain bearing.

6. Electromagnetic actuator according to claim 3, wherein the movable pole body can move relative to a circuit body by means of a plain bearing.

7. Electromagnetic actuator according to claim 1, wherein the actuator is provided with a dust cap that screens off facing pole surfaces of a circuit body and the retaining plate.

8. Method for assembling an actuator according to claim 1, wherein at least two of the cylindrical elements are fixed to one another by means of a screw fastener.

9. Method according to claim 8, wherein at least two of the cylindrical elements are fixed to one another by a press fit.

10. Assembly for fixing an actuator, such as an actuator according to claim 1, in a switching installation which has at least one movable contact of a switch, characterised in that the axial axis of the actuator is essentially perpendicular to the direction of movement of the operating means for the at least one movable contact of the switch.

11. Assembly according to claim 10, further comprising transmission means with a predetermined transmission ratio between the movement of the actuator and the movement of the operating means for the at least one movable contact of the switch.

12. Assembly according to claim 11, wherein one actuator drives three movable contacts of a switch and the predetermined transmission ratio is between 1:2 and 1:2.5.

13. Electromagnetic actuator according to claim 2, wherein the actuator comprises essentially cylindrical elements.

14. Electromagnetic actuator according to claim 2, wherein the electromagnetic actuator comprises a movable shaft joined to the movable pole body, which shaft can move relative to the fixed pole body by means of a plain bearing.

15. Electromagnetic actuator according to claim 3, wherein the electromagnetic actuator comprises a movable shaft joined to the movable pole body, which shaft can move relative to the fixed pole body by means of a plain bearing.

16. Electromagnetic actuator according to claim 4, wherein the electromagnetic actuator comprises a movable shaft joined to the movable pole body, which shaft can move relative to the fixed pole body by means of a plain bearing.

17. Electromagnetic actuator according to claim 4, wherein the movable pole body can move relative to the circuit body by means of a plain bearing.

18. Electromagnetic actuator according to claim 5, wherein the movable pole body can move relative to the circuit body by means of a plain bearing.

19. Assembly according to claim 12, where the predetermined transmission ratio is 1:2.2.

* * * * *